US006464652B1

(12) United States Patent
Hubbard et al.

(10) Patent No.: US 6,464,652 B1
(45) Date of Patent: Oct. 15, 2002

(54) METHODS AND EQUIPMENT FOR TREATING OR PREVENTING MUSCLE PAIN OR INJURY

(75) Inventors: David R. Hubbard; Paul Johnson, both of San Diego, CA (US)

(73) Assignee: CorSolutions, Inc., Buffalo Grove, IL (US)

( * ) Notice: Subject to any disclaimer, the term of this patent is extended or adjusted under 35 U.S.C. 154(b) by 553 days.

(21) Appl. No.: 08/812,260

(22) Filed: Mar. 6, 1997

(51) Int. Cl.[7] ..... A61H 1/02

(52) U.S. Cl. ..... 601/5; 601/39; 601/26; 601/34

(58) Field of Search ..... 601/5, 23, 24, 601/26, 33–35

(56) References Cited

U.S. PATENT DOCUMENTS

| | | | | |
|---|---|---|---|---|
| 3,834,694 A | | 9/1974 | Pridgen | |
| 4,089,330 A | | 5/1978 | Nicolosi et al. | |
| 4,387,894 A | | 6/1983 | Baumann | |
| 4,445,684 A | | 5/1984 | Ruff | |
| 4,456,249 A | | 6/1984 | Calabrese | |
| 4,629,185 A | | 12/1986 | Amann | |
| 4,750,741 A | | 6/1988 | Smolanovich | |
| 4,768,779 A | | 9/1988 | Oehman, Jr. et al. | |
| 4,819,936 A | | 4/1989 | Muller | |
| 4,844,453 A | | 7/1989 | Hestilow | |
| 4,893,808 A | | 1/1990 | McIntyre et al. | |
| 4,979,736 A | | 12/1990 | Maynard | |
| 5,108,090 A | | 4/1992 | Reed | |
| 5,122,106 A | | 6/1992 | Atwood et al. | |
| 5,137,504 A | | 8/1992 | Mangini | |
| 5,242,356 A | * | 9/1993 | Grenfell | |
| 5,258,019 A | * | 11/1993 | Riddle et al. | |
| 5,277,681 A | | 1/1994 | Holt | |
| 5,282,835 A | * | 2/1994 | Wright et al. | |
| 5,324,246 A | | 6/1994 | Wang | |
| 5,324,247 A | | 6/1994 | Lepley | |
| 5,364,326 A | | 11/1994 | Smith et al. | |
| 5,421,801 A | | 6/1995 | Davies, III et al. | |
| 5,444,882 A | | 8/1995 | Andrews et al. | |
| 5,487,590 A | | 1/1996 | Haynes | |
| 5,529,560 A | | 6/1996 | Davies, III et al. | |
| 5,588,704 A | * | 12/1996 | Harza | 601/98 X |
| 5,746,704 A | * | 5/1998 | Schenck et al. | 601/40 |

FOREIGN PATENT DOCUMENTS

| | | | | |
|---|---|---|---|---|
| GB | 2094627 | * | 9/1982 | 601/90 |

* cited by examiner

*Primary Examiner*—Danton D. DeMille
(74) *Attorney, Agent, or Firm*—Gardner Carton & Douglas

(57) ABSTRACT

Machines for treating or preventing neuromuscular pain conditions and injuries by slow patientcontrolled stretching of a muscle or group of muscles when they and surrounding muscles are in a relaxed state (i.e., with little or no extrafusal muscle fiber contractions). The machines include a fixed support such as seat. An adjustable support, such as a back or side rest is adjusted for the particular patient. A controllable support moved in an alternating motion, under the patient's control, allows the injured or painful muscle to be slowly stretched by gravity, while the muscles are relaxed. The controllable support is preferably moved by a hydraulic cylinder.

25 Claims, 9 Drawing Sheets

150
147
142
150
140
151
148
154
146
136
162
137
138
141
135
149
170
152
134
90
168

METHODS AND EQUIPMENT FOR TREATING OR PREVENTING MUSCLE PAIN OR INJURY

BACKGROUND OF THE INVENTION

The field of the invention is apparatus and methods for treating muscles and neuromuscular pain conditions.

Muscle injuries and pain, common among athletes and manual laborers, occur in the general population, due to accidents, over-exertion, and/or poor ergodynamic and working conditions. These types of injuries occur often in the neck, arms, hip, back, and shoulders.

Traditional therapies, such as in muscle strengthening, the most common approach to physical therapy, have no proven effect and often aggravate the pain. Other techniques such as heat or ultrasound are passive and also unproven. Active stretching of the muscle is more effective but has been traditionally performed by physical manipulation of the patient by the therapist, often resulting in over-stretch and a reaction of muscle tightening.

When a muscle is acutely strained, as in a lifting injury, there is pain in the injured muscle until tightness, swelling, bleeding and inflammation subside. Muscles surrounding the injured area tighten up in order to splint the site and prevent further damage, and these surrounding muscles also become painful. In addition, the muscle stretch receptors, called muscle spindles, become contracted. This spindle spasm can become chronic if tension coexists causing a sympathetically-mediated activation of the spindle.

SUMMARY OF THE INVENTION

It has now been discovered that, in contrast to prior physical therapy practices which emphasize muscle strengthening and/or active stretching, muscle injury and pain conditions are more effectively prevented or treated by using body weight and gravity to stretch, preferably slowly stretch, the injured or painful muscle while surrounding muscles are maintained in a generally relaxed state. This is accomplished by placing the body in such a position that muscles other than the muscle to be treated are relaxed while the injured or painful muscle, for example, is placed in such a position that body weight, optionally assisted by the addition of further weight, can be used to accomplish the treatment stretch. This is preferably accomplished with novel equipment designed to promote this gravity or relaxed stretching. Examples of such equipment are described and claimed herein. This equipment also preferably includes a means for allowing the stretch to be accomplished slowly and for returning the stretched muscle to the starting position without voluntarily contracting said muscle. The muscle injury prevention and therapy machines described herein offer an appropriate amount of muscle stretch, to reduce the risk of injury or reinjury and provide longer lasting relief, and accelerated patient improvement. The patient, via actuators on the machines, can control the degree of stretch on the affected muscle and then return to a neutral position, while maintaining a relaxed state in a gravity-dependent position. By providing for the addition of further weight, in the form of independent weight devices (such as weighted pads), or a means for adding a weight or weights to the equipment itself (such as by a tubular bar for holding barbell-type weights, secured to that portion of the equipment which moves to permit the stretch) and a means for securing the muscle to be treated to the equipment (such as by a strap), the gravity stretch may be enhanced.

BRIEF DESCRIPTION OF THE DRAWINGS

In the drawings, wherein similar reference denote similar elements throughout the several views.

DETAILED DESCRIPTION OF THE PREFERRED EMBODIMENTS

The most effective therapy for muscle injury and pain involves the slow gentle stretching of the involved muscle or group of muscles while they and surrounding muscles are in a state of muscle relaxation, such that there are little or no extrafusal muscle fiber contractions. While traditional methods of therapy have sometimes included stretching, the stretching has typically been 1) controlled by the therapist, not the patient; or 2) has involved contraction of the surrounding muscles, especially the antagonist muscles, e.g., stretching the back extensors by actively (voluntarily) contracting the back flexors (abdominal muscles); or 3) has used too rapid a stretch; or 4) has required active contraction to restore the patient to the original non-stretched position; or 5) was directed to achieving excessive stretch rather than conscious patient perception of changes in degree of muscle stretch. The following machines and methods achieve slow gentle stretching of specific muscles or groups of muscles, with the muscles in a relaxed condition while in a gravity-dependent position, thereby achieving highly effective therapy. The following machines and methods can also be used for warm-up stretching before exercising, to reduce the risk of muscle injury during exercise.

Figure 1:
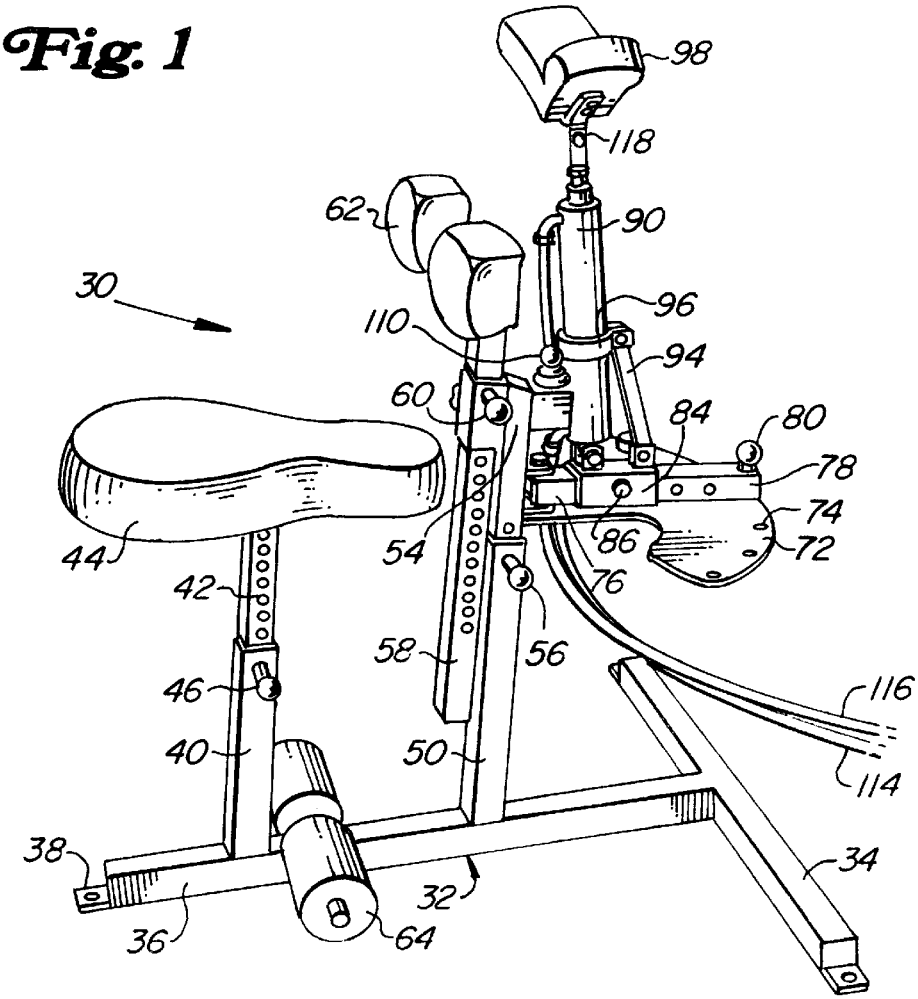
FIG. 1 is a perspective view of a first embodiment of the present invention useful, for example, for neck flexion treatment.
Figure 2:
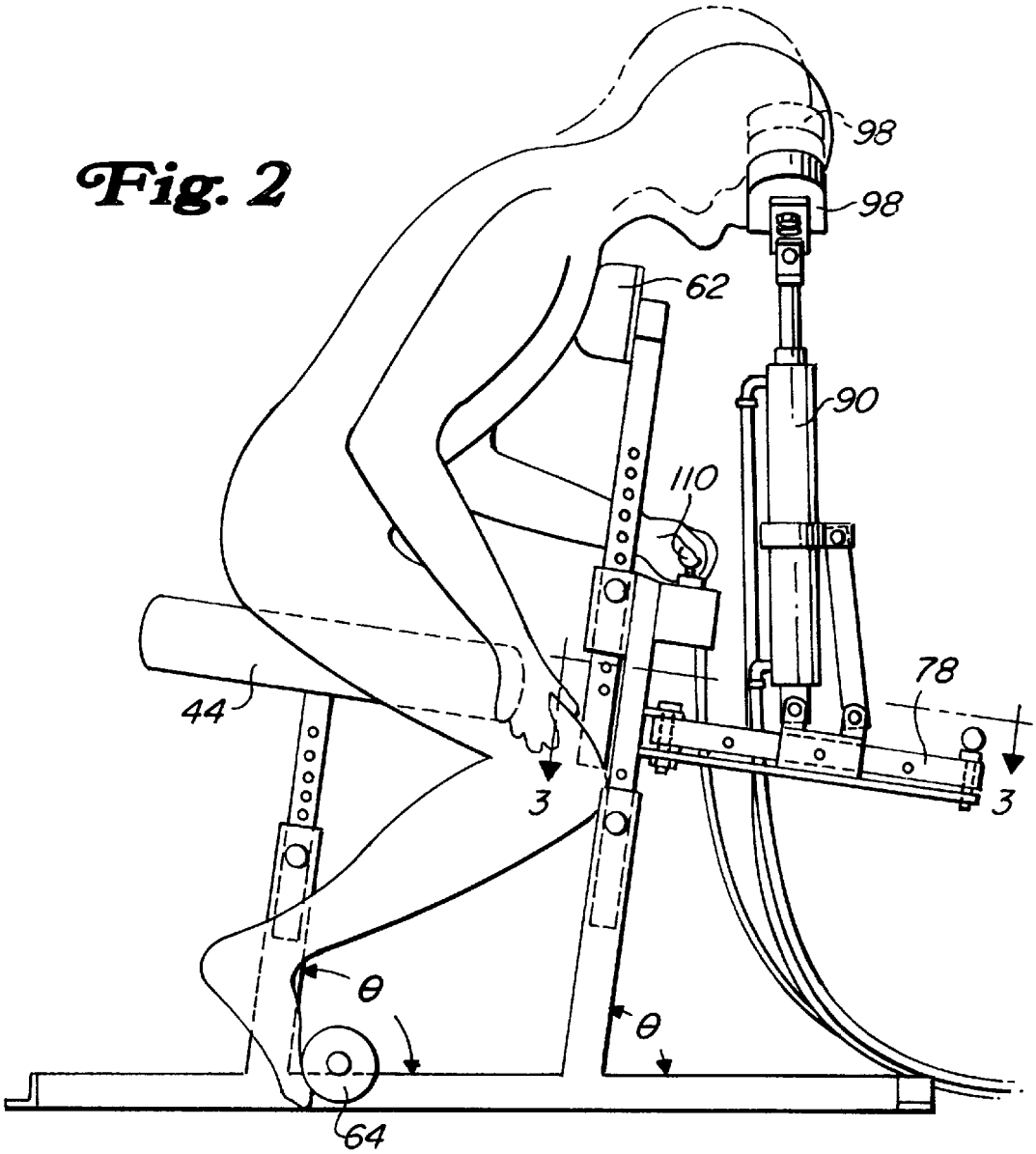
FIG. 2 is a side elevation view thereof illustrating the machine of FIG. 1 in use.

Turning now in detail to the drawings, as shown in FIGS. 1 and 2, the first embodiment 30 includes a T-shaped base 32 having a cross beam 34 attached perpendicularly to a main beam 36. Mounting holes or brackets 38 are provided on the base 32. A hollow seat pipe 40 extends vertically upwardly from the main beam 36. A seat 44 having a seat post 42 with through holes is placed in the seat pipe 40 and secured in position via a lock pin 46.

Figure 3:
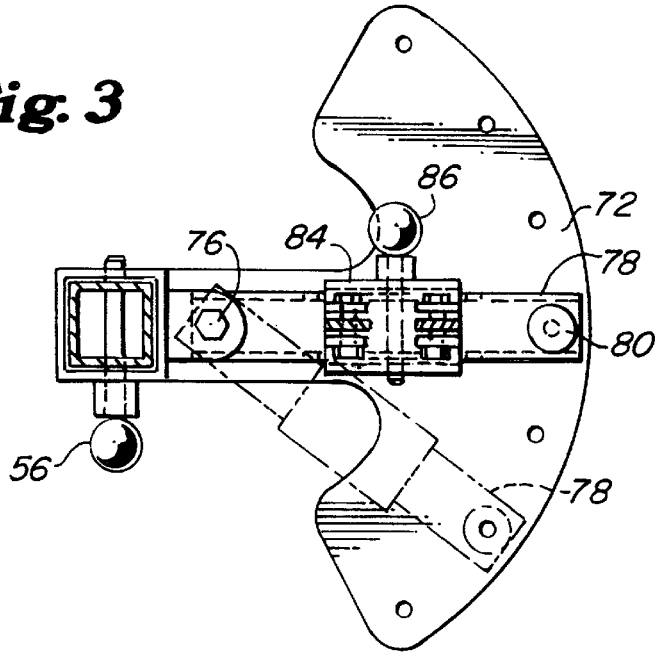
FIG. 3 is a partial section view taken along line 3—3 of FIG. 2.

Similarly, a support riser 54 with through-holes can be vertically raised or lowered in a riser pipe 50 via a riser pin 56 extending through the riser pipe 50 and a riser section 54. A torso bar 58 is similarly vertically adjustable on the riser 54 via torso bar pin 60 extending through holes in the torso bar 58. Torso pads 62 are attached at the upper end of the torso bar 58. Foot pads 64 are attached to the main beam, just froward of the seat pipe 40. Referring now to FIGS. 1 and 3, the arm 78 is pivotally attached the riser 54 through a hinge joint 76. An (azimuth) angle plate 72 is joined to the riser 54. As shown in FIG. 3, the angle plate 72 has a plurality of spaced apart holes 74, allowing the arm 78 to swing arc-like in either direction, and be locked at any particular angle by an arm pin 80 extending through a hole 74 in the angle plate 72 and into the arm 78. Referring to FIG. 2, the seat pipe 40 and riser pipe 50 are inclined at angle θ, preferably ranging from about 70° to 88°, and more preferably about 82°, forwardly, (towards the end of the machine at the cross beams 34).

As best shown in FIG. 2, the lower end of an actuator, such as hydraulic cylinder 90, is pivotally attached to a collet 84 slidably positioned over the arm 78. Other actuators including electric, pneumatic, mechanical, etc. may also be used. The collet can slide in and out on the arm 78, to shift the position of the lower end of the hydraulic cylinder 90 towards and away from the patient. A collet pin 86 extending through the collet 84 and arm 78 locks the lower end of the hydraulic cylinder into a desired position on the arm 78. An angle linkage 94 and a clamp ring 96 are used to adjust and hold the inclination angle of the hydraulic cylinder toward the patient.

Hydraulic supply and return lines 114 and 116 extend from a hydraulic system (not shown) to a counter-balance valve 112 connecting to the hydraulic cylinder 90. The counterbalance valve 112 is controlled by hand control 110. A headpiece 98 is attached to the upper end of the hydraulic cylinder 90 via a swivel joint 118. The swivel point allows the headpiece 98 to be moved into a desired position.

The embodiment shown in FIGS. 1–3 is intended for treatment of neck pain, cervical strain, and whiplash. It is also be useful for treating tension headache and myofascial pain syndrome. It can work on the sternocleidomastoids, splenius, levator scapulae and trapezium muscles. It can also be modified for treatment of other muscles. In use the patient adjusts the seat height, angle (if any) of the arm 78, height of the torso pads 62, and position of the base of the hydraulic cylinder 90 attached to collet 84, by using the lock pins provided for each of those functions. The patient may also slide close to or away from the torso bar 58, because of the extended seat length. The vertical position of the arm 78 is preferably adjusted by a technician.

The patient rests the forehead on the headpiece 98 and places the hands on the hand controls 110. A variety of headpieces 98 are preferably provided, to match the patient and application. The headpieces 98 may be, for example, pillow, keyhole, or banana-shaped. The patient adjusts the position of the headpiece 98 and then locks it in position by placing weight of the head on headpiece 98. With the patient in the starting position, as shown in phantom in FIG. 2, and with the machine 30 appropriately set, the patient actuates the hand control 110 to retract and lower the piston 92 into the hydraulic cylinder 90, to a neutral position, between the anticipated full extension and full retraction positions for desired stretch. One technique is for the patient to stay in the stretch position for one slow inhale and exhale. This technique promotes awareness of the state of muscle stretch. After achieving a relaxed stretch, the patient reverses direction and, using the hand control 110, causes the piston 92 to extend back to its original position. The patient may perform these steps as often as desired. The movement of the patient'head and neck are shown in FIG. 2. The patient remains seated at all times.

With the arm 78 straight ahead (at 12 o'clock) the motion is pure forward flexion (the C-4 to C-7 vertebrae). If the base of the piston is changed to about 70 degrees and extended away from the patient by approximately 3–6 inches, the forward flexion will be from the T-4 to C-4 vertebrae. If the arm 78 is swung out to one side by about 20 degrees, as shown in phantom in FIG. 3, then the rotational and extensor muscles of the neck are also stretched.

The degree and speed of lowering and raising is under patient control. The stretch protocol can be progressed incrementally over time, with the patient advantageously working from a guideline for each week, based on past progress. The speed of actuator movement (in all embodiments) is preferably from about 0.1–2.0 about inches/second and more preferably about 0.5 inches/second.

Figure 4:
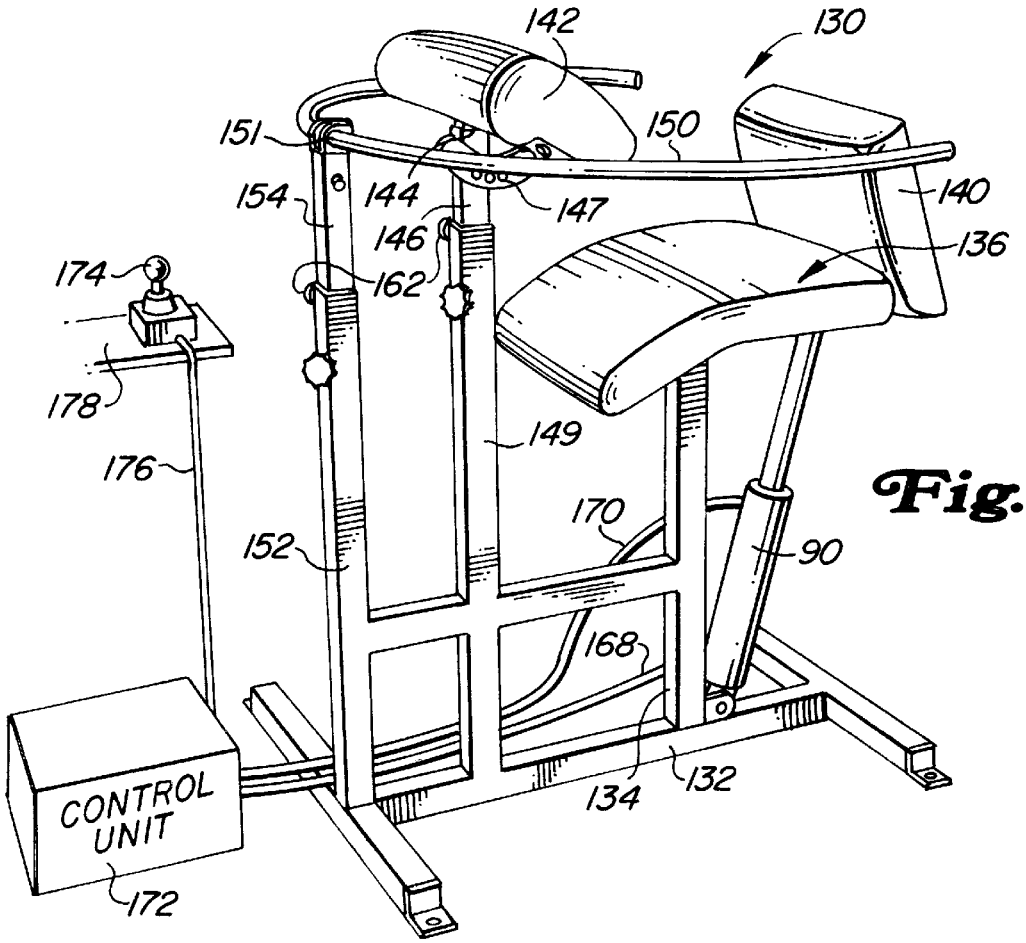
FIG. 4 is a perspective view of a second embodiment of the invention, useful, for example, for treatment of the quadratus lumborum.
Figure 5:
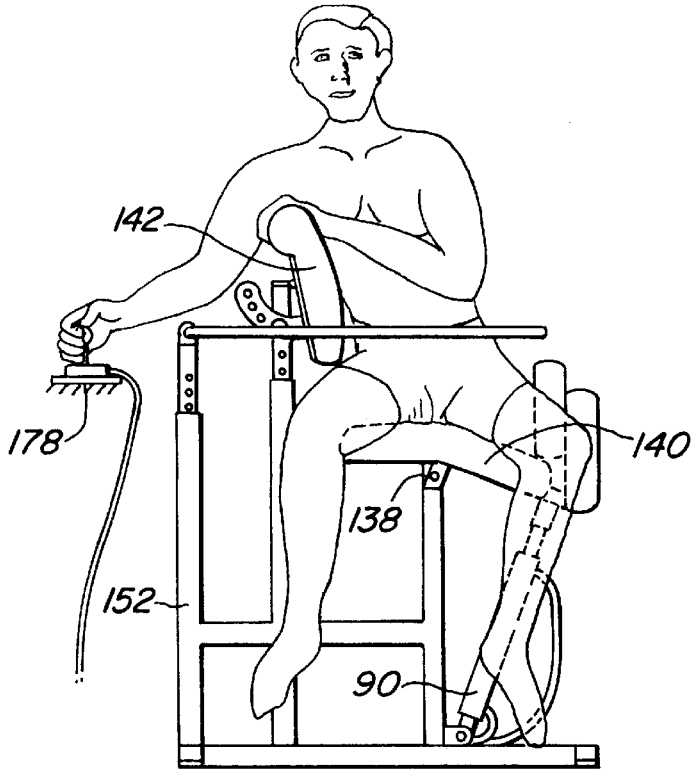
FIG. 5 is a front elevation view thereof.
Figure 6:
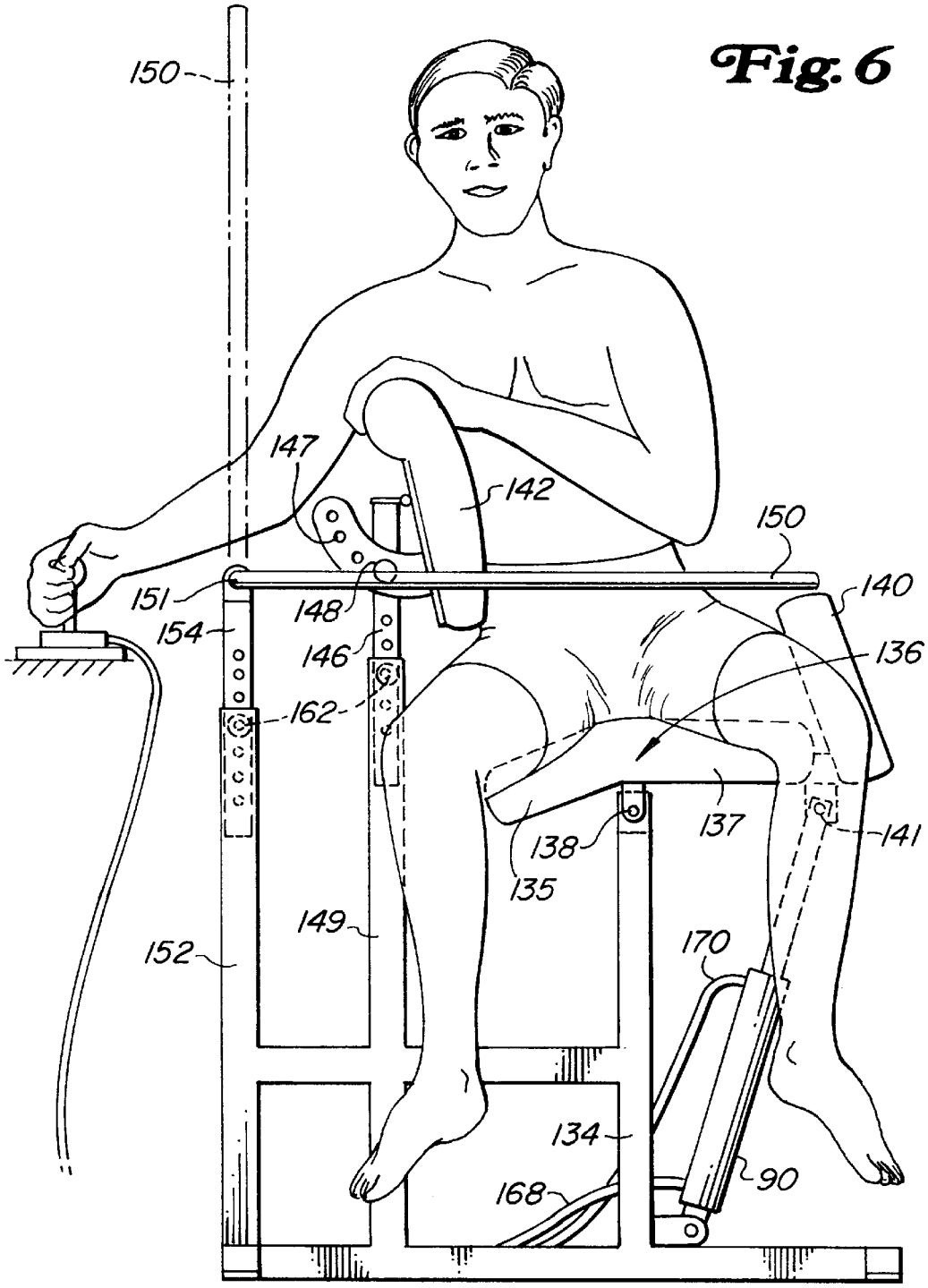
FIG. 6 is an enlarged front elevation view showing of the machine of FIGS. 4 and 5 in use.

As shown in FIGS. 4 and 5, a machine 130 useful for quadratus lumborum treatment includes a base 132, a seat tube 134 attached to the base 132, and a seat 136 pivotally attached on top of the seat tube 134 via a pivot joint 138. The seat has an inner section 135 set as an angle to an outer section 137. A seat end 140 is attached to the outer seat section 137. A hydraulic cylinder has a lower end pivotally attached to a mount on the base 132, and an upper end pivotally attached to an extension mount on the seat end 140 with an eyelet and clevis pivot 141 (FIG. 6). Hydraulic lines 168 and 170 connect the hydraulic cylinder to a control unit 172. A hand controller 174 on a platform 178 is connected to the control unit 172 via control line 176. The controller 174 preferably is provided in the form of a joystick moveable between up and down positions, through a center neutral or stop position. The platform 178 may be attached to the handle tube 152.

A handle riser 154 with through-holes is vertically adjustable via a pin 162 within a riser tube 152 attached to the base 132. A side support pad 142 is pivotally attached to a riser pad mounting bar 146 with through-holes vertically positionable within a side pad tube 149. An angle plate 147 and pin 148 (FIG. 6) allows the side support pad 142 to pivot to various angles. A semi-circular handle bar 150 extends around either side of the seat 136. The handle pivots up on a handle pivot joint 151, and is attached to riser support bar 154.

The embodiment shown in FIGS. 4–6 is primarily intended for treatment of lower back including the quadratus lumborum muscle. In use, the side pad 142 height and angle is adjusted for the patient. The seat 136 is initially level. The patient approaches the seat so that the affected side will be on the outside of the machine away from pad 142. The patient sits on the seat and allows his legs to dangle down freely. The patient then slides to the far inside of the seat until the side pad 142 is against his side and the top of the pad is several inches under the axillary region. The torso is therefore supported on the side opposite to the side being stretched. The patient may increase the stretch by holding onto the curved handle 150 in front of him. The patient is also able to lean forward or twist away from the side being stretched, to enhance the effects of the stretch. The patient may also lean over the side torso pad (lateral flexion away from the stretch) which puts the portion of the quadratus opposite this, on greater stretch.

The patient then grasps the handle of the controller 174 with his free hand. By advancing the controller or joystick forward, the seat begins to lower the affected side. Specifically, the controller 174 causes the hydraulic cylinder 90 to retract, moving the seat 136 smoothly about the pivot joint 138. Since the inner seat 135 is angled downwards relative to the outer seat 137, it elevates less as the outer seat 137 lowers. As this occurs, the patient's back sequentially extends laterally and interiorly stretching the quadratus lumborum muscle in a controlled and relaxed manner. "Relaxed" means with little or no required extrafusal muscle contraction. As the side being stretched slowly lowers, the patient determines the amount of stretch by joystick control.

When the desired range of movement is reached, the patient moves the handle control 174 the other direction, causing the hydraulic cylinder 90 to extend, pushing the seat 136 back to the horizontal position. It is preferable to pause briefly at each increase of stretch. After sufficient repetitions, the patient switches sides and repeats the process, to stretch the opposite quadratus lumborum in the other direction. FIG. 5 shows the seat in the down (stretched) position while FIG. 6 shows it in the up (start) position.

Figure 7:
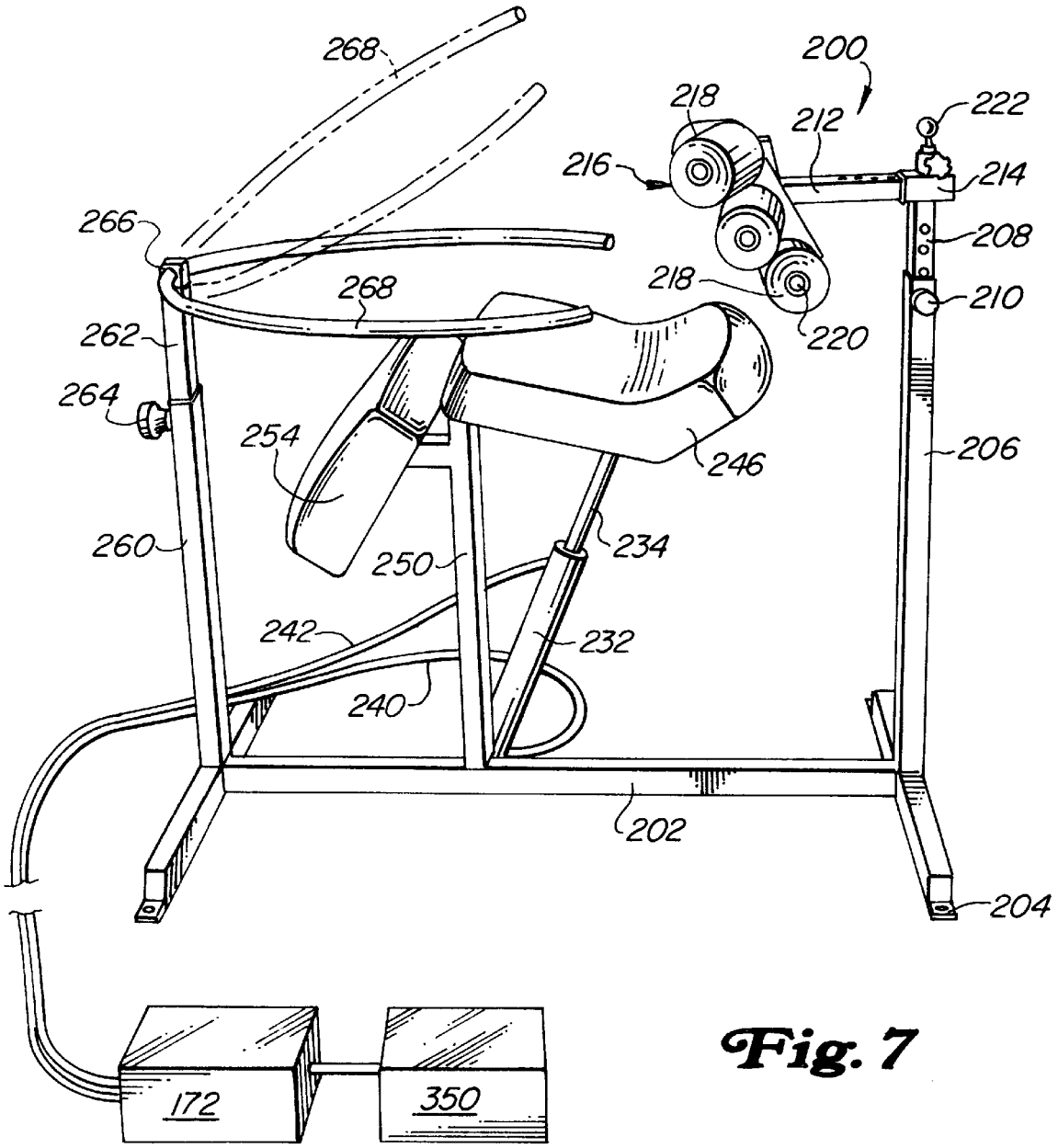
FIG. 7 is a perspective view of a third embodiment of the invention, useful, for example, for treating back extensor muscles.

Turning to FIG. 7, an embodiment 200 useful for treating back extensor muscles, has a base 202 and floor mounting plates 204. A back support post 206 attached to the base 204 telescopically supports a back pad riser 208. The riser 208 has a plurality of vertically spaced apart holes, so that the vertical position of the back support riser 208 may be adjusted in the back support post 206 using a riser pin 210. A back pad arm 212 with through-holes extends forwardly from an arm bracket 214 attached to the back pad riser 208.

Figure 9:
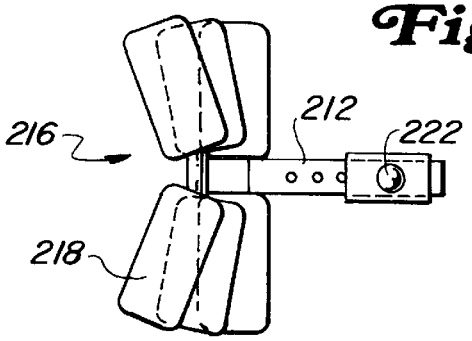
FIG. 9 is a partial top view taken along line 9—9 of FIG. 8.

Turning to FIGS. 7 and 9, a back pad assembly 216 is attached at the front end of the arm 212. The back pad assembly 216 includes padded rollers 218 supported on roller supports 220. The front to back position of the back pad assembly 216 may be adjusted by sliding the arm 212 front or back and locking the arm in position on the bracket 214 via an arm pin 222, extending through a selected hole in the arm 212.

Figure 8:
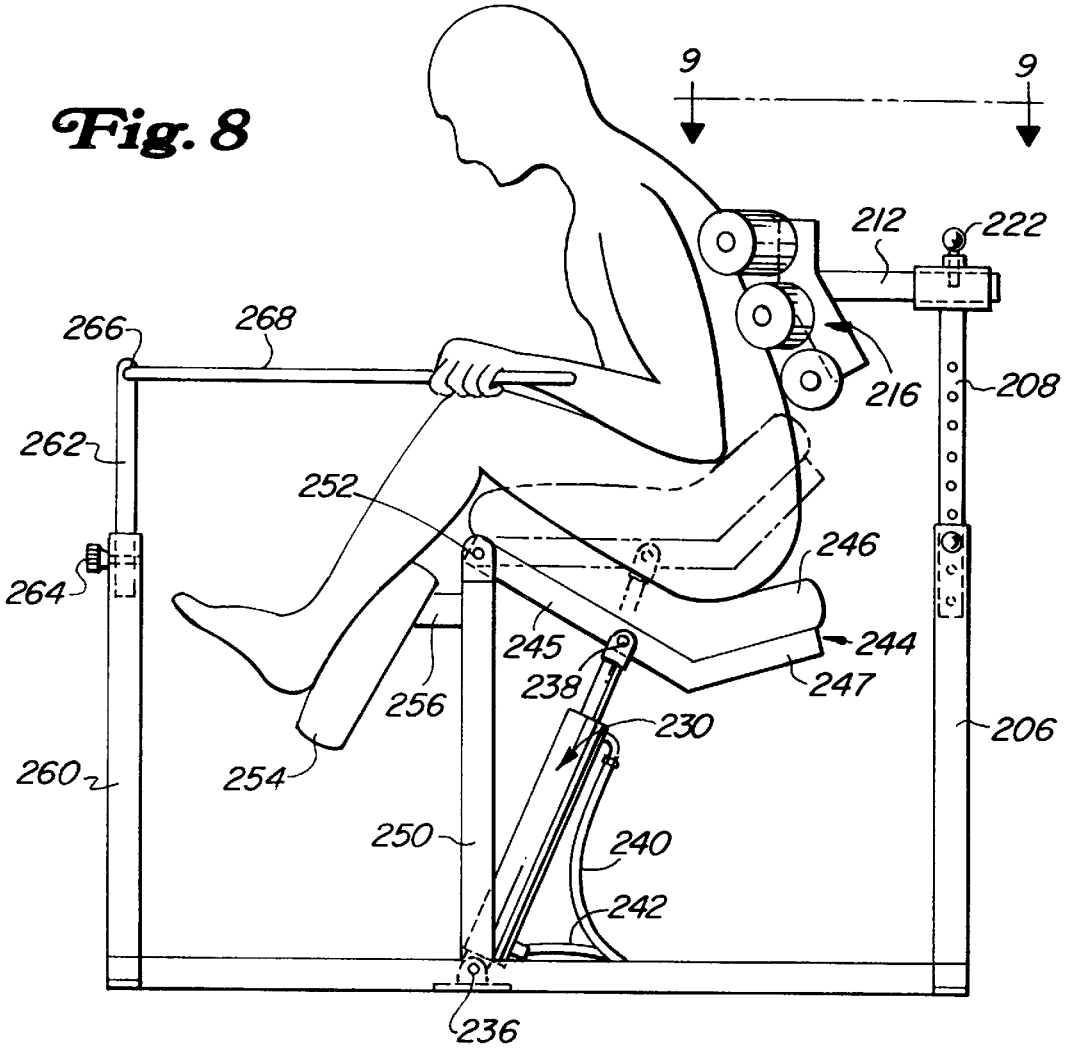
FIG. 8 is a side elevation view of the machine of FIG. 7 in use.

Turning to FIG. 8, the embodiment 200 includes an actuator 230 pivotally attached to the base 202 via a pivot 236. Hydraulic lines 240 and 242 connect to a center-balance valve in a patient hand controller (not shown) as described above with reference to FIG. 4. A seat support 244 is pivotally attached a seat post 250 extending up from the base 202 via a seat pivot 252. A seat pad 246 is attached to the seat support 244, forming a seating surface having a straight or flat inner end 245, and an upwardly angled outer end 247. The piston 234 is attached to the underside of the seat support 244 at a piston pivot 238.

A leg pad 254 is supported on a leg pad arm 256 extending perpendicularly forward from the seat post 250. The leg pad 254 preferably forms an acute angle with the seat post.

A handle bar post 260 extends upwardly from the base 202, and telescopically supports a semi-circular handle bar riser with through-holes 262 in an adjustable vertical position via a pin 264 extending through the post 260 and a selected hole in the riser 262. Referring momentarily to FIG. 7, a c-shaped handle bar 268 is attached to the handle bar riser 262 at a handle bar pivot 266, so that the handle bar 268 can pivot upwardly (as shown in phantom in FIG. 7).

In use, the patient raises the handle bar 268, sits on the seat pad 246 and then lowers the handle bar. The patient's legs rest on the leg pad 254, and the patient's back is positioned against the back pad assembly 216, with the seat in the upright and horizontal position, as shown in phantom in FIG. 8. This is the start position. The patient holds the handle bar 268 with one hand, with the other hand on the controller 174. By operating the controller, the patient causes the actuator 230 to slowly retract. As this occurs, the seat 246 slowly pivots downwardly about pivot 252. Correspondingly, the patient'torso flexes forwardly. The roller pads 218 roll upwardly on the patient's back. As shown in FIG. 9, the lower roller supports 220 are straight across, the middle set of rollers is inclined inwardly, and the top set of roller supports is inclined inwardly still farther.

After the patient has reached the maximum comfortable stretch position (which will vary from patient to patient, and will also vary for the same patient depending on various factors), using the controller 174, the patient then reverses the procedure by causing the actuator 230 to extend, thereby pivoting the seat back to its horizontal starting position.

Figure 10:
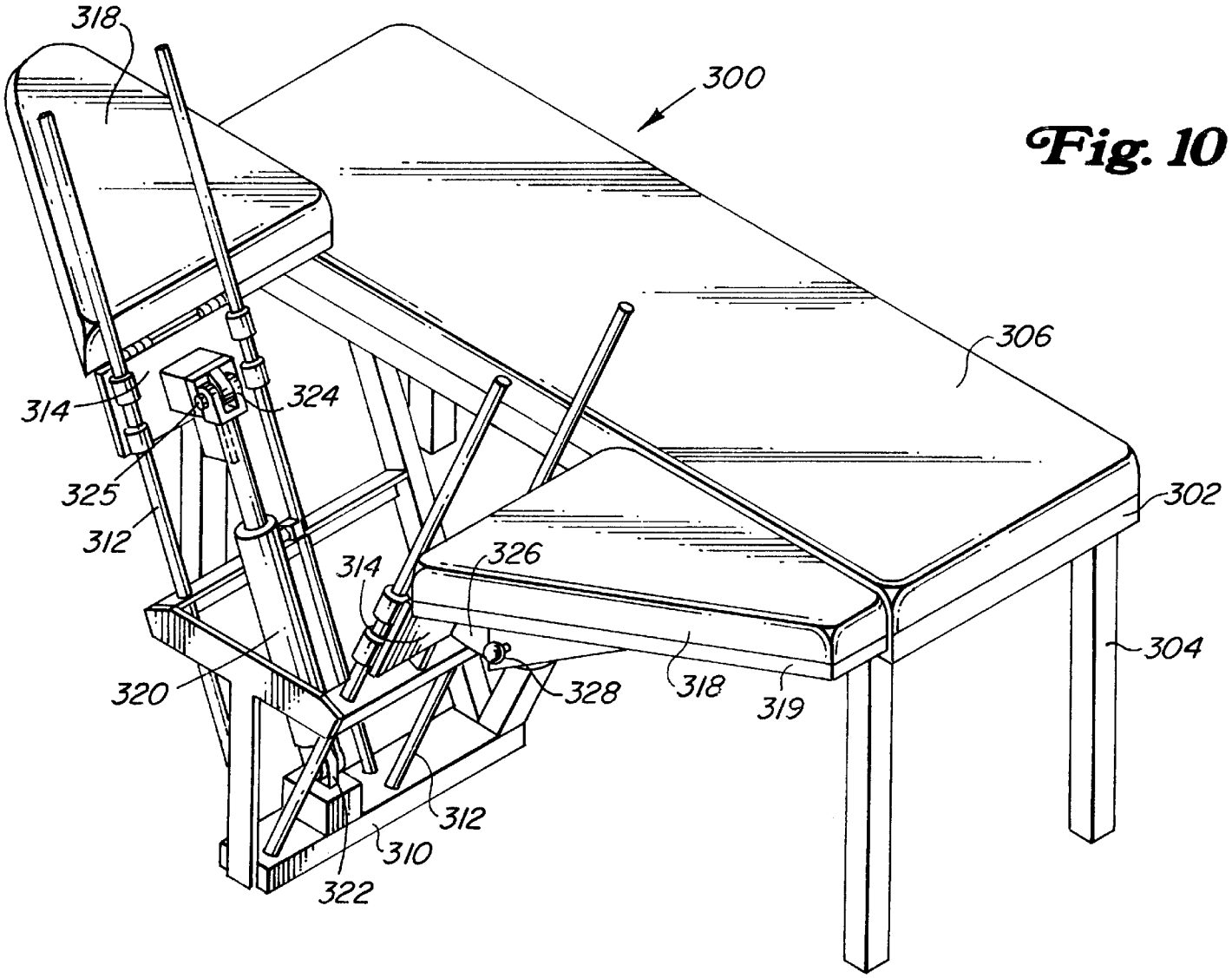
FIG. 10 is a perspective view of a fourth embodiment of the invention, useful, for example, for treating hip muscles.
Figure 11:
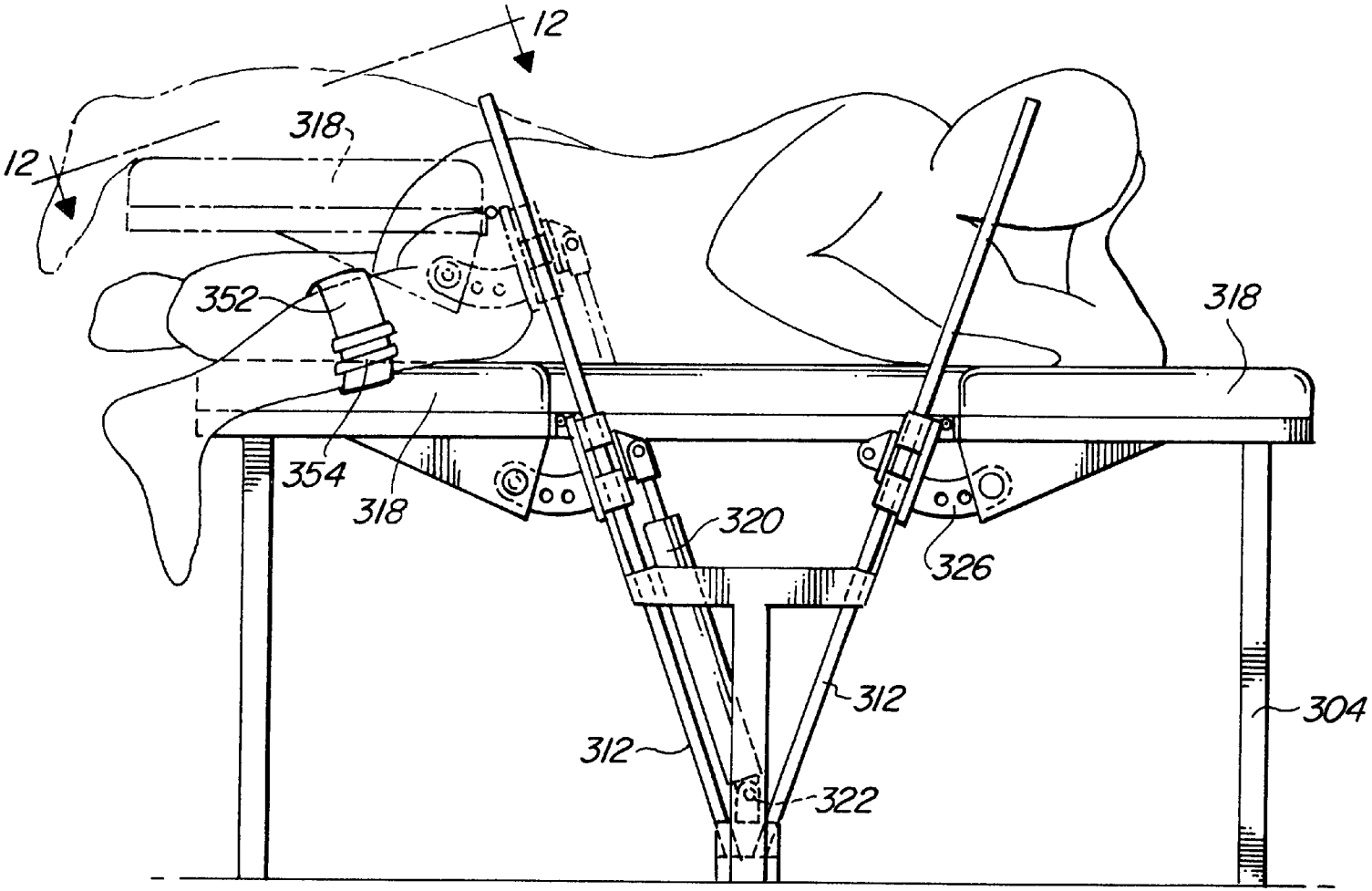
FIG. 11 is a front elevation of the machine of FIG. 10 in use.
Figure 12:
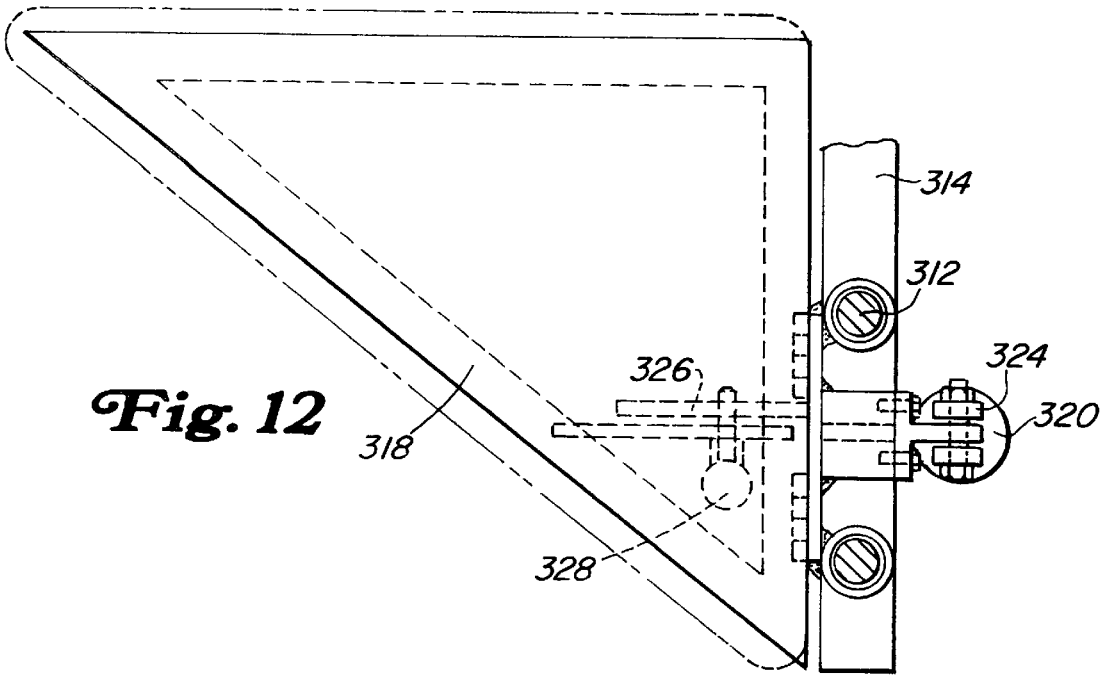
FIG. 12 is a partial plan view of the adjustable leg support taken along line 12—12 of FIG. 11.

Turning to FIGS. 10–12, in an embodiment 300 useful, for example, for treating hip muscles, includes a frame 302 is supported on legs 304. A frame extension 310 supports movable leg pads 318 on leg frame supports 319. A frame pad 306 extends over the entire top of the frame 302. A slide plate 314 is attached to each leg pad 318 and is vertically displaceable along guide bars 312. An actuator 320 is attached to the lower end of the frame extension 310 at a lower pivot joint 322. The upper end of the actuator 320 is attached to one of the slide plates 314 at a slide plate pivot joint 324 via an attachment pin 325. The pin 325 can be quickly removed to switch the attachment of the actuator 320 from one slide plate to the other. An elevation plate 326 is attached to each slide plate 314 and extends under each leg support 319. An elevation pin 328 allows the leg frame support 319 and pad 318 to be tilted up or down about an axis parallel to the pin 328.

In use, as shown in FIG. 11, the patient lies on the frame pad 306 on his side. The patient's top leg (the right leg in FIG. 11) rests on the leg pad 318 in the elevated position, as shown in phantom in FIG. 11, with the patient'lower leg on the frame pad 306. Leg position may be improved by pivoting the frame 319 and the pad 318 with slide adjustment mount 326 down from level, and securing them in place via the locking pin 328. Using a hand controller 174, as shown and described above with reference to FIG. 6, the patient controls the actuator 320 which slowly drops the leg pad 318, e.g., to the position shown in solid lines in FIG. 11. The patient's hip and leg muscles are preferably relaxed, with all lifting performed entirely by the actuator 320. After the leg pad 318 has reached the patient's desired degree of hip stretch, the patient reverses the hand controller 174 to cause the leg pad 318 to move back up to its original position above the level of the frame pad 306. To treat hip muscles on the other side, the patient reverses position on the frame pad 306, so that the upper leg becomes the lower leg on the opposite leg pad, and the stretching procedure repeated.

The embodiment 300 can also be used for treating shoulder muscles, i.e., the infraspinatus, teres major and rhomboid. In this application, the patient lays on the frame pad 306 face up, with patient'forearm on the leg pad 318. The movement of the leg pad, as described above, then stretches the shoulder muscles.

A computer or microprocessor controller 350, as shown in FIG. 7, may also be used to control the machines described above. The computer can be programmed to provide specific speeds and durations of stretch, thereby simplifying use of the machines by patients.

Under certain conditions, it may be preferable for the body part being treated to be weighted down. Straps 352 with weights 354 can be placed over the body part for this purpose, for example as the body part is stretched on a machine.

Various other muscles, such as the latissimus dorsi and the brachioradialis can also be stretched using the machines described herein, or with modifications that would be apparent to those skilled in the art.

Thus, while several embodiments and applications of the methods and apparatus of the invention have been shown and described, it will be apparent to those skilled in the art that many more modifications, substitutions, and equivalents are possible without departing from the inventive concepts herein and to treat additional muscle groups. The invention, therefore, should not be restricted, except in the spirit of the following claims.

We claim:

1. A method of treating neuromuscular pain or injury of a patient comprising the steps of:

supporting the patient's body on a first support and a second support with the first support supporting the weight of the patient with the patient in a seated position on the first support, and with the second support supporting the patient's upper body;

moving the first support via an actuator, thereby stretching a muscle or group of muscles of the patient;

maintaining the muscle or group of muscles being stretched, and muscles surrounding them, in a relaxed condition by continuing to support the patient on the first and second supports; and with the patient in constant control of the position of the first support via a control device controlling the actuator.

2. The method of claim 1 further comprising the step of having the patient control the amount of muscle stretch while the patient remains supported on at least the first support.

3. The method of claim 1 wherein the patient controls the amount and duration of muscle stretch while the patient remains supported on at least the first support.

4. The method of claim 1 wherein the second support is alongside a first side of the patient's torso and the second support supports the first side of the patient's torso, and the muscle treated is the quadratus lumborum muscle on a second side of the patient, opposite the first side.

5. The method of claim 1 wherein the second support has a generally vertical surface which supports a side of the patient's torso.

6. The method of claim 1 wherein the muscle is the quadratus lumborum.

7. The method of claim 1 further comprising the step of having the patient control the speed of movement of the first support.

8. A muscle therapy machine comprising:

a base;

a seat for supporting a patient in a seated and upright position, the seat having an inner section and an outer section, and with the seat pivotably attached to the base at a location between the inner section and the outer section;

a side support attached to the base at a position above the seat, for supporting one side of the patient's torso, above the hip and below the arm of the patent, in a substantially fixed, non-moving position;

an actuator connected to the seat; and a controller for controlling the actuator to move the seat in a direction at least partially towards and away from gravity, such that a muscle of the patient be stretched via gravity while remaining in a relaxed condition.

9. The machine of claim 8 wherein the second patient support laterally supports the patient's torso, and the actuator pivots the first support away from the second support to achieve a stretch of the targeted muscle or group of muscles in a relaxed condition and for returning from stretch without the patient contracting muscles, and the controller linked to the actuator allows the patient to control the extent and duration of stretch, of pausing at varying degrees of stretch to allow release of resistance to stretch, and of the return to the non-stretched condition.

10. The machine of claim 8 further comprising means for positioning the second patient support into one of several fixed positions.

11. The machine of claim 8 wherein the second patient support laterally supports the patient's torso.

12. The machine of claim 8 wherein the actuator is pivotably attached to the base at a fixed pivot joint.

13. The machine of claim 8 wherein the actuator is a linear actuator attached directly to the seat and to the base.

14. A machine useful for treating quadratus lumborum muscle injury or pain comprising:

a base;

a seat attached to the base at a pivot point, the seat having a first and second end;

an actuator extending between the base and the seat;

a side pad supported on the base adjacent the first end of the seat with the pivot point located between the first and second ends of the seat; and an actuator controller linked to the actuator, with the actuator adapted to tilt the seat toward and away from the side pad.

15. The machine of claim 14 wherein the first end of the seat extends at an angle to the second end of the seat, so that the first end of the seat is horizontal when the seat is tilted towards the side pad, and so that the second end of the seat is horizontal when the seat is tilted away from the side pad.

16. The machine of claim 15 wherein the first and second ends of the seat join each other at an angle positioned adjacent to the pivot joint.

17. The machine of claim 14 further comprising a handlebar supported on the base.

18. The machine of claim 14 wherein the actuator controller comprises a joystick, having means for controlling the direction, speed, and the starting and stopping of movement of the actuator, while the machine is in use by a patient.

19. The method of claim 1 further comprising the step of positioning the first support vertically so that the patient's legs dangle freely.

20. A method of treating muscle injury or pain of a patient comprising the steps of:

providing support of the patient's torso or limbs so that the muscles are in a condition of muscle relaxation;

stretching by force of gravity a targeted muscle or group of muscles in a condition of muscle relaxation;

pausing the stretch to allow the patient to release the resistance to stretch;

returning the muscle or group of muscles to a condition of non-stretch without muscle contraction; and having the patient constantly in control of the degree of stretch, the duration of stretch, the duration of release of resistance to stretch and the return to the non-stretched condition.

21. The method of claim 20 wherein the torso or limb are moved upward and downward in the direction of gravity by the patient controlling an actuator.

22. A method of treating neuromuscular pain or injury of a patient comprising the steps of:

supporting the patient's body on a first support and a second support;

incrementally moving the first support in a step movement from a first position to a second position via an actuator, thereby stretching a muscle or group of muscles of the patient;

maintaining the muscle or group of muscles being stretched, and muscles surrounding them, in a relaxed condition by continuing to support the patient on the first support in the first position and on the second support;

holding the first support in the second position for a first selected duration of time;

incrementally moving the first support from the second position to a third position in a step movement, via the actuator, thereby further stretching the muscle or group of muscles;

holding the first support in the third position for a second selected duration of time;

continuing to maintain the muscle or group of muscles being stretched, and the muscles surrounding them, in a relaxed condition by continuing to support the patient on the first support in the third position and on the second support; and with the patient controlling the position and movement of the first support via a control device controlling the actuator.

23. A method of treating neuromuscular pain or injury of a patient comprising the steps of:

supporting the patient's body on a first support and a second support;

moving the first support downwardly via patient control to a first position via a linear actuator, thereby stretching a muscle or group of muscles of the patient and providing a sensation of stretch to the patient;

maintaining the first support in the first position and maintaining the muscle or group of muscles being stretched, and muscles surrounding them, in a relaxed condition by continuing to support the patient on the first support in the first position and on the second support;

holding the first support in the first position via patient control, to allow the patient'sensation of stretch to decrease; and moving the first support further downwardly to a second position, below the first position, via patient control of the linear actuator.

24. The method of claim 23 further comprising the step of having the patient control the speed of movement of the actuator.

25. A method of treating neuromuscular pain or injury of a patient comprising the steps of:

supporting the patient's body on a first support and a second support with the first support supporting the weight of the patient with the patient in a seated position on the first support, and with the second support supporting the patient's upper body;

moving the first support in a first direction, thereby stretching a muscle or group of muscles of the patient;

stopping the first support at a stretch position selected by the patient;

moving the first support in a second direction, opposite to the first direction; and maintaining the muscle or group of muscles being stretched, and muscles surrounding them, in a relaxed condition by continuing to support the patient on the first and second supports.

* * * * *